United States Patent [19]

Dorsman

[11] Patent Number: 4,528,495

[45] Date of Patent: Jul. 9, 1985

[54] FLOATING PRECISION CURRENT SOURCE

[75] Inventor: Adrian K. Dorsman, Sheldon, Iowa

[73] Assignee: Rockwell International Corporation, El Segundo, Calif.

[21] Appl. No.: 560,774

[22] Filed: Dec. 12, 1983

[51] Int. Cl.[3] ..... G05F 1/46

[52] U.S. Cl. ..... 323/268; 323/281

[58] Field of Search ..... 323/268, 269, 271–274, 323/280, 281, 313, 314

[56] References Cited

U.S. PATENT DOCUMENTS 3,623,140 11/1971 Nercessian ..... 323/268

4,315,207 2/1982 Apfel ..... 323/272 X

*Primary Examiner*—Peter S. Wong

*Attorney, Agent, or Firm*—H. Fredrick Hamann; James F. Kirk

[57] ABSTRACT

A floating precision current source circuit comprising: a voltage source means referenced to a reference potential, such as ground, for providing at least one precision voltage reference, and a floating first means for generating a precision unipolar current, the floating first means being responsive to the precision voltage reference and having: a current source terminal, and a current sink terminal; the floating first means being characterized as sourcing the precision unipolar current to the current source terminal and sinking the precision unipolar current from the current sink terminal; load switching means for coupling the current source terminal at a first potential to the load terminal at a second potential; the floating first means being further characterized as controlling the value of the precision unipolar current from the current source terminal, through the load switching means to the load terminal, the precision unipolar current value being relatively independent of the current source terminal first potential and the current sink terminal second potential.

7 Claims, 6 Drawing Figures

FLOATING PRECISION CURRENT SOURCE

RELATED APPLICATIONS

This application is related to the following concurrently filed application and patent, which is incorporated herein by reference: A. K. DORSMAN, IMPROVED CLOCKED PRECISION INTEGRATING ANALOG-TO-DIGITAL CONVERTER SYSTEM, Ser. No. 56,773.

BACKGROUND OF THE INVENTION

1. Field of the Invention

This invention relates to a floating precision current source circuit for use as a precision current reference with circuits such as analog-to-digital converter circuits, et al., this invention circuit having particular advantage when used with multi-channel Analog-to-Digital Converter Systems requiring high precision and very low drift.

2. Description of the Prior Art

Prior art current sources circuits applicable for use in precision Analog-to-Digital converters, and other uses, are typically designed to be either a floating type with an internal reference source or, a non-floating type, with an external reference source. The non-floating type using an externally referenced source has the advantage of allowing multiple stages to be referenced from a common external reference source. However, precision digital-to-analog converters having the best bias offset and drift performance typically require the use of current source of the floating type for each channel. The drift characteristics of each respective channel in these systems is influenced by the drift of the precision current source, the drift of each precision current source in turn being dependent on the drift characteristics of as many as five resistors in each current source circuit as well as the respective voltage source for the channel.

SUMMARY OF THE INVENTION

It is a major objective of this invention to provide a floating precision current source circuit suitable for use with multiple channel analog-to-digital converter systems.

Another objective of this invention floating precision current source circuit is to provide a precision current source circuit capable of being referenced to a single referenced voltage source referenced to a reference potential, such as ground.

Yet another object of the invention floating precision current source circuit is to provide a precision current source circuit design adapted to permit the use of several invention current source circuits coupled to one common precision voltage reference.

Another object of this invention is to characterize each floating precision current source circuit as being adjusted by varying the value of a single resistor.

Yet another objective of this invention is to characterize each respective floating precision current source circuit used with a multiple channel system A-D Converter System as having a drift characteristic matched to that of other additional floating precision current source analog-to-digital converter circuits by matching the temperature sensitivity, aging, thermal shock, mechanical shock, soldering shock, and lead bending sensitivity of the single resistor used in each floating precision current source circuit.

Yet another objective is to provide a floating precision current source analog-to-digital converter circuit having fewer parts (resistors) than conventional current source circuits.

DESCRIPTION OF THE PREFERRED EMBODIMENT

Figure 1:
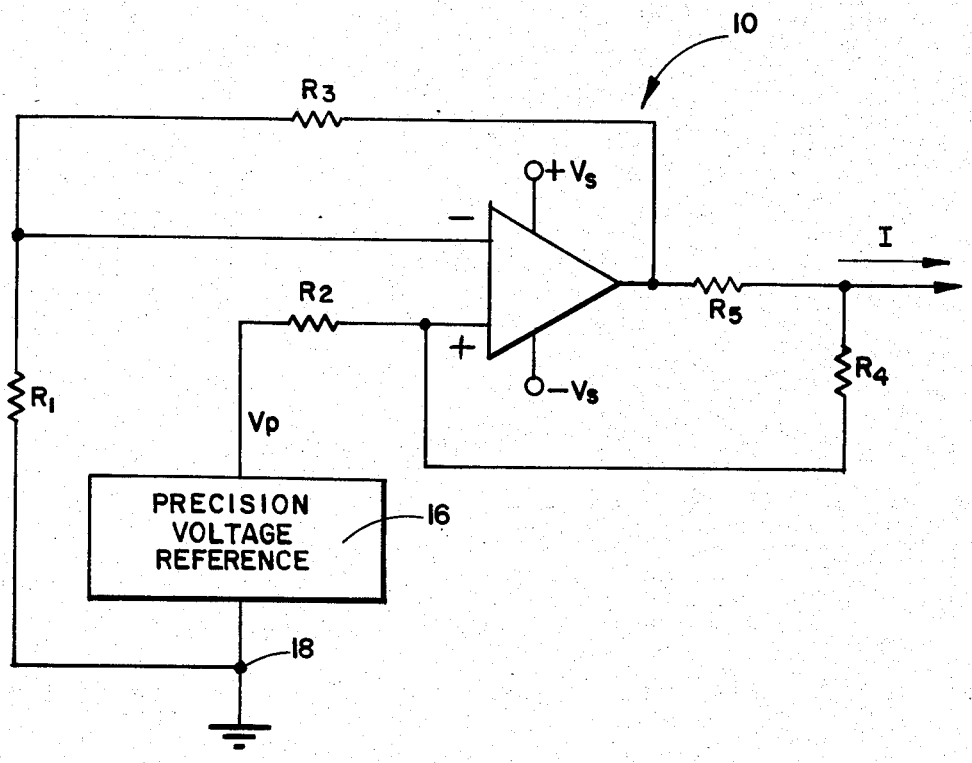
FIG. 1 PRIOR ART
FIG. 1 is a schematic diagram of a prior art current source circuit driven by an external voltage reference.

FIG. 1 shows a schematic diagram of a prior art current source circuit 10 driven by an external precision voltage reference. It can be shown that the output current, I for the circuit 10 is equal to:

$$I=(R3/R1)*(Vp/R5) \text{ if} \quad 1.$$

$$R2=(R4+R5)*(R1/R3) \quad 2.$$

The disadvantages of this circuit include the fact that the current source is ground referenced at 18 and cannot be floated with a reference used in common by other current sources. Another disadvantage of the current source circuit 10 is that the accuracy and stability of the circuit depends on the stability of resistors R5 and the stability of the ratios of R3:R1 and R4:R5. Yet another disadvantage of the current source of FIG. 1 is that this circuit draws a significant current from the precision voltage reference 16.

Figure 2:
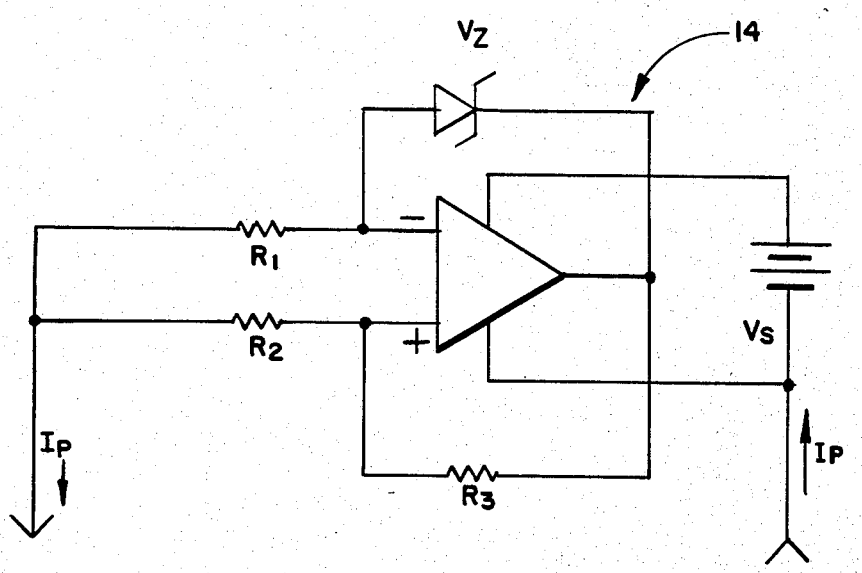
FIG. 2 PRIOR ART
FIG. 2 is a schematic of a second Prior Art current source with an internal reference.

The prior art circuit of FIG. 2 shows a floating current source 14 having an internal reference voltage. It can be shown that the output and input current Ip is equal to:

$$Ip=(Vz/R3)*(1+(R2/R1))$$

The circuit 14 of FIG. 2 has the disadvantage of requiring a separate zener reference for each independent channel. The scale factor drift associated with each channel is, therefore, independent of the drift of other channels. Several channels having the same component values can therefore drift in completely random fashion. Another disadvantage of the circuit 14 of FIG. 2 is that the stability of the circuit depends on the stability of the zener voltage reference Vz, the stability of R3 and the ratio stability of R1:R2.

Figure 3A:
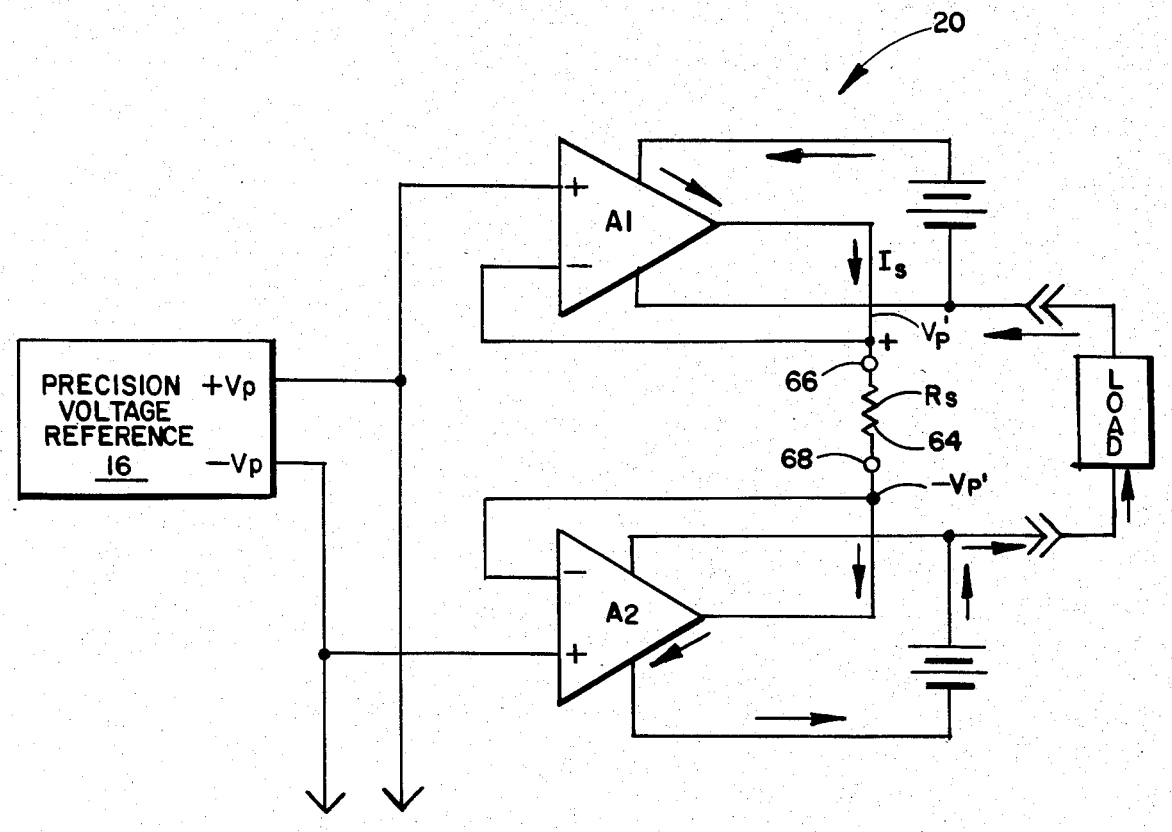
FIG. 3*a* is a simplified block diagram of the floating precision current source circuit.

FIG. 3*a* is a simplified block diagram of the invention floating precision current source circuit 20. Amplifiers A1 and A2 are connected to function as voltage follower circuits. Amplifier A1 responds to precision voltage reference +Vp and produces voltage +Vp′ at the scaling resistor 64 first terminal 66. Amplifier A2 is also connected as a voltage follower and responds to the precision voltage reference −Vp to provide voltage −Vp′ at resistor 64 second terminal 68. The output current Is is determined by the following relationship:

$$Is=((+Vp')-(-Vp'))/R_s \quad 4.$$

The variable $R_s$ represents the scaling resistor 64. Equation 4, above, shows that the output current of the invention precision unipolar current source is only dependent on the stability of the precision voltage reference and on the single scaling resistor $R_s$. The invention circuit has the added advantage of requiring an extremely small current from the voltage references +Vp and −Vp.

Figure 3B:
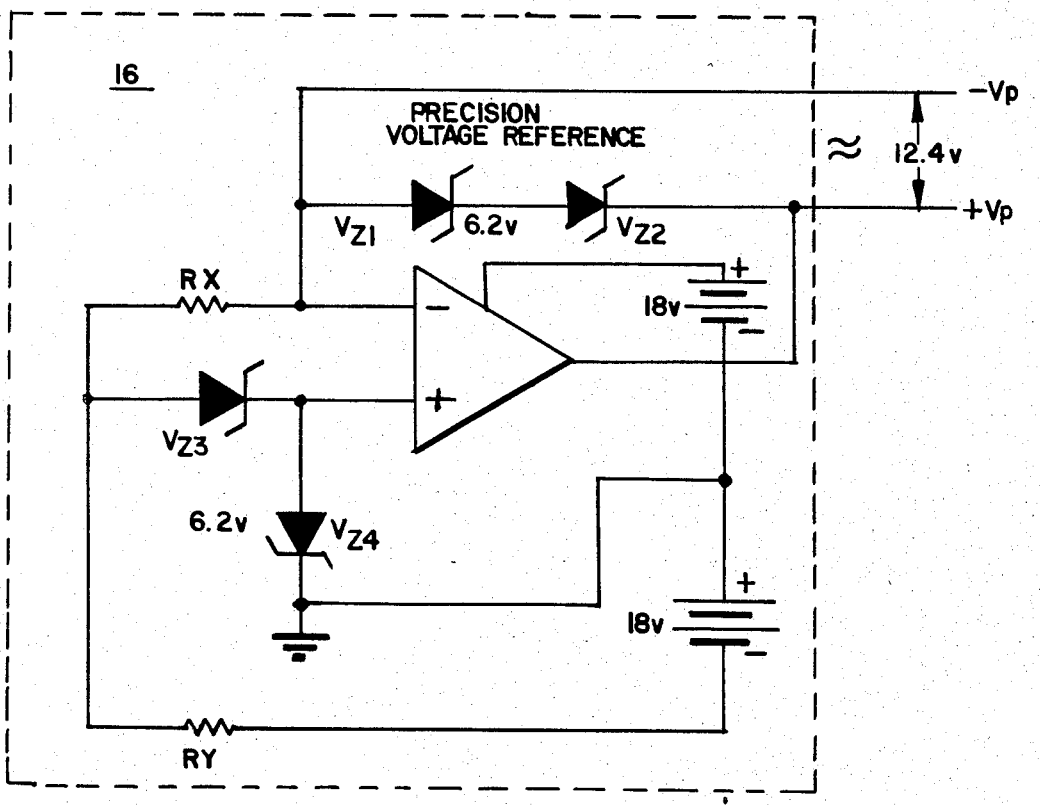
FIG. 3*b* is a schematic of a typical precision voltage reference.
Figure 4:
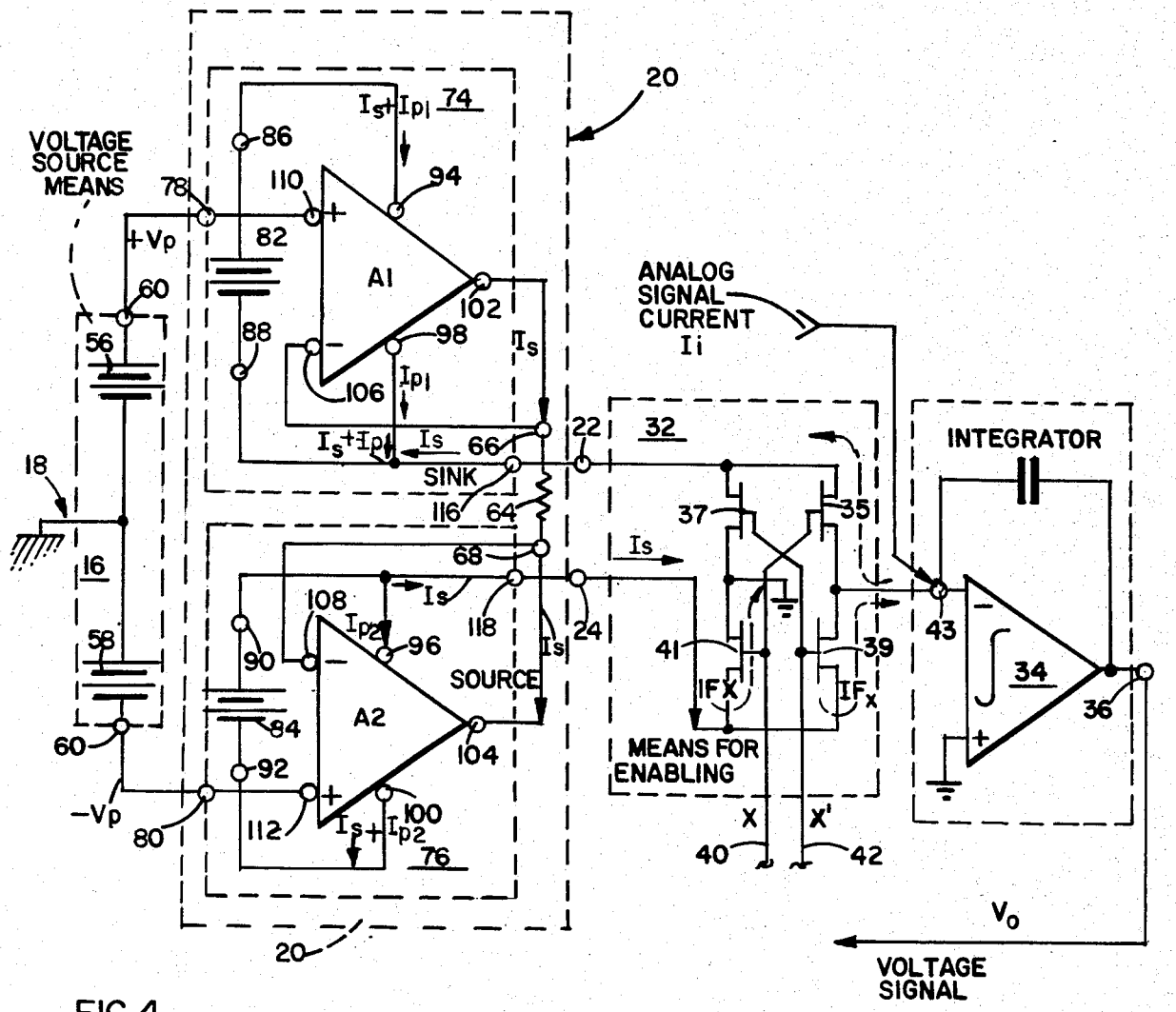
FIG. 4 is a schematic of the floating precision current source circuit driving a load.

FIG. 4 depicts a schematic diagram of the invention floating precision current source circuit 20. The floating precision current source circuit is shown having a voltage source means, represented by block 16, referenced to a reference potential, such as ground 18, for providing at least one precision voltage reference, such as +Vp and −Vp. FIG. 4 shows voltage source means 16 as including a differential voltage reference source, such as first and second voltage references 56, 58, respectively, having first and second reference voltage source terminals 60, 62. The differential reference voltage source 16 provides first and second reference voltages +Vp, −Vp, respectively, with respect to the reference potential, such as ground 18, at the first and second reference voltage source terminals 60, 62. FIG. 3*b* represents a preferred embodiment of a precision reference voltage source. The +18 V source of FIG. 3*b* provides a bias current through zener diodes $V_{Z3}$ and $V_{Z4}$, the bias current being limited by resistance $R_y$. The (−) and (+) inputs of the amplifier of FIG. 3*b* are at essentially the same voltage, i.e. $-V_{Z4}$ volts below ground. The voltage across the resistance $R_x$ is fixed at $V_{Z3}$ Volts; thereby, fixing the current through zener diodes $V_{Z2}$ and $V_{Z1}$ from the +Vp output from the output of the amplifier. By selecting zener diodes to have equal zener voltages, $-V_p$ can be made essentially equal to $+V_p$. The reference of 16 can service the reference voltage inputs for several floating precision current source circuits of type 20.

The floating first means 20 has: a current scaling resistor 64 having a first and second terminal 66, 68 respectively; a current sink terminal 22 coupled to a load means, such as enabling means 32; and, a current source terminal 24, also coupled to enabling means 32. The floating first means has a first floating voltage follower means 74 coupled to the current sink terminal 22 for coupling the unipolar current from the current sink terminal 22 to the resistor first terminal 66; and a second floating voltage follower means, such as that represented by block 76, for coupling the unipolar current from the resistor second terminal 68 to the current source terminal 24. The first and second floating voltage follower means 74, 76 each have respective inputs 78, 80 coupled to respective first and second reference voltage source terminals 60, 62, respectively. The first floating voltage follower 74 provides a voltage essentially equivalent to the first reference voltage +Vp at the resistor first terminal 66; and, the second floating follower means 76 provides a voltage essentially equivalent to the second reference voltage −Vp at the resistor second terminal 68. The load means, such as phantom block 32 is characterized as sourcing the unipolar current to the current sink terminal 22 and is also characterized as sinking the unipolar current from the current source terminal 24. The first and second voltage follower means 74, 76 operate to control the unipolar current magnitude to be equal to the voltage difference between the first and second reference voltages, +Vp and −Vp, to the scaling resistor 64 resistance.

The load switching means can be any type of load; however, for purposes of illustration, the load means is represented by the contents of the enabling means in phantom block 32, a typical switching circuit for directing the flow of the precision current into or out of load terminal 43, the summing point for an integrator circuit for generating a ramp voltage. The load switching means of FIG. 4 is represented by two pairs of switches. The pairs of switches are configured in a bridge array of first and second pairs of switches, the first pair being designated by the symbol X′ and comprising switches 37, 39 and the second pair being designated by the symbol X comprises switches 35, 41. The first pair of switches designated by X′ enables the unipolar current to flow by way of a first path from the reference potential, such as ground 18, through the first X′ switch 37 to the floating first means current sink terminal 22. The unipolar current then proceeds through the floating first means 20 to the floating first means current source terminal 24 and through the second X′ switch 39 to the load terminal 43 during the first mode of operation.

The second pair of switches designated by X and comprising switches 35, 41 enables the unipolar current to flow by way of a second path from the load terminal 43 through the first X switch 35 to the floating first means current sink terminal 22, through the floating first means 20 to the floating first means current source terminal 24 through the second X switch 41 to the voltage reference terminal, such as ground 18, during the second mode of operation.

FIG. 4 also shows a preferred embodiment of the floating first means as contained in phantom block 20 wherein each respective first and second floating voltage follower means 74, 76 respectively, further comprises: a respective isolated differential voltage source 82, 84 having at least an output terminal 86, 90 and a respective return terminal 88, 92. Each respective first and second floating voltage follower means 74, 76 also has a respective differential amplifier A1, A2. Each respective amplifier has a respective power input terminal 94, 96 coupled to its respective isolated differential voltage source power terminal 86, 90 and its respective power return terminal 98, 100 coupled to its respective isolated differential voltage source return terminal 88, 92. Each respective differential amplifier A1, A2 also has a respective output terminal 102, 104; a respective inverting input terminal 106, 108 and a non-inverting input terminal 110, 112. The first respective differential amplifier A1 output terminal 102 is coupled, i.e. connected, to the first differential amplifier A1 inverting input terminal 106 and to the scaling resistor first terminal 66. The second differential output terminal 104 is coupled to the second differential amplifier A2 inverting input terminal 108 and to the scaling resistor second terminal 68. The first differential amplifier power return terminal 98 is coupled to the current sink terminal 22; and, the second differential amplifier power input terminal 96 is coupled to the current source terminal 24.

The first differential amplifier operates to conduct unipolar current from the current sink terminal 22 to the scaling resistor first terminal 66 and the second differential amplifier A2 operates to conduct the unipolar current from the scaling resistor second terminal 68 to the current source terminal 24. The first and second differential amplifiers A1, A2 are each isolated, i.e. each has no reference connection to a reference potential such as ground 18, other than through their respective voltage reference +Vp and −Vp, each is powered by its respective isolated differential voltage source.

Amplifiers A1 and A2 each require a relatively small power supply current to operate. Referring to FIG. 4, these currents are designated as $I_{p1}$ and $I_{p2}$. $I_{p1}$ leaves the A1 power return terminal 98 and passes through floating voltage source 82 along with $I_s$. The current entering terminal 94 is the sum of $I_s+I_{p1}$. In a similar fashion, $I_{p2}$ enters the A2 power input terminal 96, passes through A2 and exits the A2 power return terminal 100 with $I_s$. The sum of the $I_s$ and $I_{p2}$ currents pass through floating voltage source 84.

FIG. 4 shows that each respective differential amplifier is connected to operate as a voltage follower as described. The first voltage follower 74 reproduces the voltage +Vp at resistor first terminal 66 and the second voltage follower 76 reproduces the voltage −Vp at resistor second terminal 68. The result of this operation is to fix the voltage difference across the precision scaling resistor 64; thereby, fixing the current through the precision scaling resistor 64. Since amplifiers A1 and A2 have essentially infinite input impedance at their respective non-inverting inputs 110, 112, essentially no current passes into or out of these terminals. The current passing through resistor 64 circulates through load means 32. Small differences in the voltage across respective switches within load means 32 as a result of different FET switch voltage drops, from one channel to another, do not influence the current circulating through the switches. The current through the switches is fixed by the difference voltage across the precision resistor 64.

Figure 5:
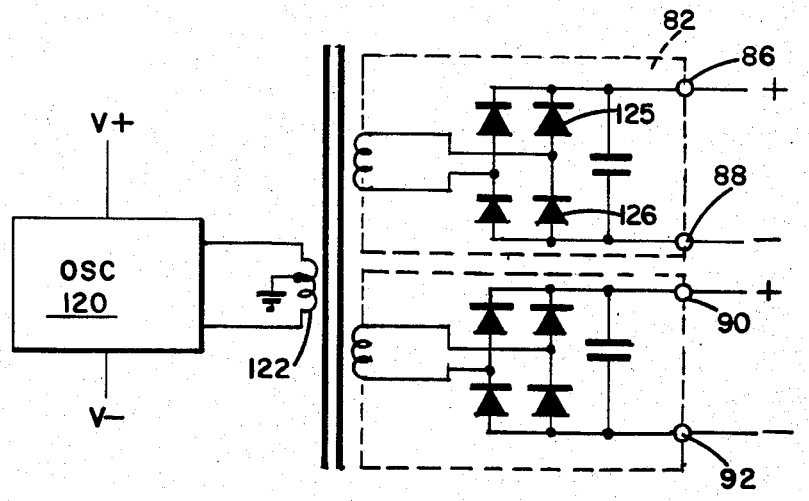
FIG. 5 is a simplified schematic of a pair of floated voltage supplies.

FIG. 5 shows a circuit suitable for providing first and second isolated differential voltage sources such as 82 and 84 for providing isolated power to the first and second voltage follower means circuits 74, 76 respectively. The circuit of FIG. 5 typically comprises a conventional oscillator 120 driving transformer 122 in push-pull fashion at a frequency of typically 50 KHz. The secondary voltages produced are square wave voltages that are rectified by diodes, such as diodes 124, 126, and by capacitor 128 to provide an isolated differential voltage source between terminal pairs 86, 88 and 90, 92. The power requirement to drive the A1 and A2 amplifiers of FIG. 4 and to source the precision current $I_s$ at current source terminal 22 is, therefore, reflected to and derived from the V+ and V− source of FIG. 5.

The A1 and A2 amplifiers are typically monolithic circuits having inputs, such as 110 and 106 that require virtually no current. A typical amplifier suitable for use in this application would include the Harris Semiconductor HA-5130 having a maximum input bias current of 2 nano amps. The offset voltage is typically less than 10 micro volts.

Operating as a voltage follower, in the circuit of FIG. 4, amplifiers of this type would produce a voltage across the scaling resistor 64 essentially equal to the precision voltage reference difference voltages between terminals 78 and 80; by essentially equal, we mean within a few microvolts. It should be noted that monolithic operational amplifiers of this type conventionally incorporate internal compensation.

The preferred embodiment uses precision voltage references that are essentially equal, i.e. +Vp=−Vp; however, circuit operation is not restricted to this requirement. In addition, although the isolated voltage sources 82, 84 are equal in the preferred embodiment, this is also not a requirement. The magnitude of these sources must be sufficient to support linear operation of the A1 and A2 amplifiers. No uncontrolled current path from the respective amplifiers should be permitted to insure that all current passes through the scaling resistor 64.

While the salient features have been illustrated and described, it should be readily apparent to those skilled in the art that modifications can be made within the spirit and scope of the invention as set forth in the appended claims.

What is claimed is:

1. A floating precision current source circuit comprising:

a voltage source means referenced to a reference potential, such as ground, for providing:

a differential voltage reference source having first and second reference voltage source terminals, said differential reference voltage source providing first and second reference voltages with respect to said reference potential at said first and second reference voltage source terminals, and a floating first means for generating a precision unipolar current, said floating first means being responsive to said differential voltage reference source and having a scaling resistor, having a predetermined resistance value, and a first and second terminal;

said floating first means also having a current source terminal, and a current sink terminal;

a first floating voltage follower means having an input coupled to said first voltage reference source terminal;

a sink terminal coupled to said current sink terminal, and an output terminal for providing an output voltage essentially equivalent to said first reference voltage, said floating voltage follower coupling said first floating voltage follower output voltage to said current scaling resistor first terminal, and coupling said unipolar current from said current sink terminal to said scaling resistor first terminal;

a second floating voltage follower means having an input coupled to said second voltage reference source terminal, a source terminal coupled to said current source terminal and an output terminal for providing a voltage essentially equivalent to said second predetermined reference voltage at said current scaling resistor second terminal, said second floating voltage follower coupling said unipolar current from said scaling resistor second terminal to said current source terminal;

load means for coupling said current source terminal at a first potential to said current sink terminal at a second potential;

said floating first means controlling the value of said precision unipolar current from said current source terminal, through said load means to said current sink terminal, said precision unipolar current value being relatively independent of said current source terminal first potential and said current sink terminal second potential and relatively equal to the value of said differential voltage reference source voltage divided by said scaling resistor predetermined resistance value.

2. The combination of claim 1 wherein each respective first and second floating voltage follower means further comprises:

a respective isolated differential voltage source having at least a power and a return terminal, a respective differential amplifier, each respective amplifier having a power input terminal coupled to its respective isolated differential voltage source power terminal and its respective power return terminal coupled to its respective isolated differential voltage source return terminal, each respective differential amplifier also having, an output terminal, each respective differential amplifier output terminal being coupled to a respective voltage follower output terminal an inverting input terminal, and a non-inverting input terminal, said first differential amplifier output terminal being coupled to said first differential amplifier inverting input terminal and to said scaling resistor first terminal, said second differential amplifier output terminal being coupled to said second differential amplifier inverting input terminal and to said scaling resistor second terminal, said first differential amplifier power return terminal being coupled to said sink terminal;

said second differential amplifier power input terminal being coupled to said source terminal;

whereby, said first differential amplifier operates to conduct the precision unipolar current from said current sink terminal to said scaling resistor first terminal and said second differential amplifier operates to conduct the precision unipolar current from said scaling resistor second terminal to said current source terminal.

3. A floating precision current source circuit comprising:

a differential voltage reference source referenced to a reference potential such as ground having first and second predetermined reference voltage source terminals, said differential reference voltage source providing first and second reference voltages with respect to said reference potential at said first and second reference voltage source terminals;

a single scaling resistor having a first and second terminal and a predetermined resistance value;

a current source terminal;

a current sink terminal;

a first floating voltage follower means having an input coupled to said first reference voltage source and a sink terminal coupled to said current sink terminal, said first floating voltage follower means being characterized as providing a voltage essentially equivalent to said first reference voltage at said current scaling resistor first terminal, and as sourcing said unipolar current from said current sink terminal to said resistor first terminal;

a second floating voltage follower means having an input coupled to said second reference voltage source and a source terminal coupled to said current source terminal, said second voltage follower means being characterized as providing a voltage essentially equivalent to said second reference voltage at said current scaling resistor second terminal, and as sourcing said unipolar current from said resistor second terminal to said current source terminal, whereby, said first and second voltage follower means operate to control the unipolar current magnitude to be equal to the voltage difference between said first and second reference voltage terminals divided by the scaling resistor resistance.

4. The combination of claim 3 wherein each respective voltage follower means has an isolated power supply, and wherein each respective voltage follower means input draws essentially no current.

5. A floating precision current source circuit comprising:

a voltage source means referenced to a reference potential, such as ground, for providing at least one precision voltage reference having a predetermined voltage value, and a floating first means for generating a precision unipolar current, said floating first means being responsive to said precision voltage reference and having:

a scaling resistor, having a predetermined resistance value, and a first and second terminal;

a current source terminal, and a current sink terminal;

said floating first means being characterized as sourcing said precision unipolar current to said current source terminal and sinking said precision unipolar current from said current sink terminal;

load means for coupling said current source terminal at a first potential to said current sink terminal at a second potential;

said floating first means being further characterized to apply a voltage essentially equivalent to said voltage reference between said scaling resistor first and second terminals to control the value of said precision unipolar current from said current source terminal, through said load means to said current sink terminal, said precision unipolar current value being relatively independent of said current source terminal first potential and said current sink terminal second potential, said precision unipolar current value being relatively equal to the value of said precision voltage reference divided by said scaling resistor predetermined resistance value.

6. The combination of claim 5 wherein said voltage source means further comprises:

a differential voltage reference source having first and second reference voltage source terminals, said differential reference voltage source providing first and second reference voltages with respect to said reference potential at said first and second reference voltage source terminals, said floating first means being responsive to the voltage difference between said first and second reference voltage source terminals.

7. The combination of claim 5 wherein said floating first means further comprises:

a first floating voltage follower means having an input coupled to said first voltage reference source terminal and a sink terminal coupled to said current sink terminal, and an output coupled to said current scaling resistor first terminal, said first floating voltage follower means being characterized to provide a voltage essentially equivalent to said first reference voltage to said current scaling resistor first terminal, said first voltage follower sourcing said unipolar current to said current scaling resistor first terminal;

a second floating voltage follower means having an input coupled to said second voltage reference source terminal and a source terminal coupled to said current source terminal, and an output coupled to said current scaling resistor second terminal, said first floating voltage follower means being characterized to provide a voltage essentially equivalent to said second reference voltage to said current scaling resistor second terminal, said second floating voltage follower sinking said unipolar current from said resistor second terminal to said current source terminal;

whereby, said first and second voltage follower means operate to control the unipolar current magnitude to be equal to the quotient of the voltage difference between said first and second reference voltage terminals divided by the scaling resistor resistance.

* * * * *